US009185770B2

(12) United States Patent
Tralli et al.

(10) Patent No.: US 9,185,770 B2
(45) Date of Patent: Nov. 10, 2015

(54) FUSE AND RESISTOR DEVICE FOR A SOLID STATE LIGHTING DEVICE

(71) Applicant: KONINKLIJKE PHILIPS N.V., Eindhoven (NL)

(72) Inventors: Aldo Tralli, Eindhoven (NL); Simon Eme Kadijk, Veldhoven (NL); Melike Yavuz, Eindhoven (NL); Aart Jan Vroegop, Zaltbommel (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/405,013

(22) PCT Filed: May 30, 2013

(86) PCT No.: PCT/IB2013/054459
§ 371 (c)(1),
(2) Date: Dec. 2, 2014

(87) PCT Pub. No.: WO2013/186659
PCT Pub. Date: Dec. 19, 2013

(65) Prior Publication Data

US 2015/0181665 A1 Jun. 25, 2015

Related U.S. Application Data

(60) Provisional application No. 61/659,574, filed on Jun. 14, 2012.

(51) Int. Cl.

| | |
|---|---|
| ***H05B 33/08*** | (2006.01) |
| ***H01H 85/02*** | (2006.01) |
| ***H01H 85/52*** | (2006.01) |
| *F21K 99/00* | (2010.01) |
| *F21V 23/00* | (2015.01) |
| *F21Y 101/02* | (2006.01) |

(52) U.S. Cl.
CPC ..... *H05B 33/089* (2013.01); *H01H 85/0241* (2013.01); *H01H 85/52* (2013.01); *H05B 33/0821* (2013.01); *F21K 9/13* (2013.01); *F21V 23/006* (2013.01); *F21Y 2101/02* (2013.01)

(58) Field of Classification Search
CPC ..... H05B 33/089; H05B 33/0821
USPC ..... 315/22, 112
See application file for complete search history.

(56) References Cited

U.S. PATENT DOCUMENTS

| | | | |
|---|---|---|---|
| 3,249,798 | A | 5/1966 | Burnett |
| 3,274,426 | A | 9/1966 | Scoledge et al. |

(Continued)

FOREIGN PATENT DOCUMENTS

| | | | |
|---|---|---|---|
| EP | 0079737 | A1 | 5/1983 |
| EP | 2302980 | A2 | 3/2011 |
| GB | 637541 | A | 5/1950 |

*Primary Examiner* — Don Le
(74) *Attorney, Agent, or Firm* — Yuliya Mathis

(57) ABSTRACT

A fuse and resistor device for a solid state lighting device, wherein at least a part of the fuse and resistor device embodies a connection pin arranged to be received at a power supply socket. The connection pin comprises an elongated conducting structure, which is partly enclosed by an insulating support structure. The conducting structure comprises a dampening resistor, and the fuse and resistor device further comprises a fuse connected with the dampening resistor either a separate part or as an integral part of the conducting structure.

13 Claims, 4 Drawing Sheets

(56) References Cited

U.S. PATENT DOCUMENTS

| | | | | |
|---|---|---|---|---|
| 3,727,091 | A | 4/1973 | De Caro | |
| 5,994,845 | A * | 11/1999 | Gibboney, Jr. | 315/185 S |
| 6,094,017 | A | 7/2000 | Adamson | |
| 2008/0001551 | A1* | 1/2008 | Abbondanzio et al. | 315/291 |
| 2008/0211419 | A1* | 9/2008 | Garrity | 315/224 |
| 2008/0224623 | A1* | 9/2008 | Yu | 315/187 |
| 2010/0259956 | A1 | 10/2010 | Sadwick et al. | |
| 2011/0006680 | A1* | 1/2011 | Tanaka et al. | 315/35 |
| 2011/0018436 | A1* | 1/2011 | Wesson | 315/32 |
| 2011/0037387 | A1* | 2/2011 | Chou et al. | 315/35 |
| 2011/0156612 | A1 | 6/2011 | Kanamori et al. | |
| 2011/0198996 | A1 | 8/2011 | Lai | |
| 2011/0241551 | A1* | 10/2011 | McRae | 315/130 |

* cited by examiner

FUSE AND RESISTOR DEVICE FOR A SOLID STATE LIGHTING DEVICE

CROSS-REFERENCE TO PRIOR APPLICATIONS

This application is the U.S. National Phase application under 35 U.S.C. §371 of International Application No. PCT/IB13/054459, filed on May 30, 2013, which claims the benefit of U.S. Provisional Patent Application No. 61/659,574, filed on Jun. 14, 2012. These applications are hereby incorporated by reference herein.

FIELD OF THE INVENTION

The present invention relates to a fuse and resistor device for a solid state lighting device.

BACKGROUND OF THE INVENTION

Dimmability, i.e. the capability of being dimmed, is an important feature of future lighting applications. Dimmability is one of the enablers of a range of smart functionalities. One of the most common dimming techniques is the so called phase cut dimming, which is used in SSL (Solid State Lighting) devices, such as lamps. In order to make the SSL application compatible with phase cut dimmers, appropriate measures must be taken in the design of the driver, which drives the very light generator of the SSL device. As shown in FIG. 1, those measures typically involve the placement of fusistors 106 in cascade to the connection pins 102 connecting the SSL device 100 to the power supply, typically the mains. Phase cut dimming introduces high current peaks. In order to limit these currents, damping resistors 106 at the input of SSL device 100 are applied. Because of safety these resistors 106 are fusible, and such a fusible resistor is called a fusistor 106. The fusistors 106 are typically placed on the same circuit board 104 as the remaining driver components 108, which are in turn connected with the very light emitting unit 110, including for instance light emitting diodes 112 arranged on a further circuit board 114.

The fusistors 106 are responsible for a considerable amount of heat generation during the operation of the SSL device, in the range of 20% of the total thermal power dissipated in the driver. Moreover, stringent thermal requirements on current SSL applications require that any effort be taken to effectively manage all thermal loads, spreading them as much as possible, and removing them from thermal paths which are heavily loaded and/or poorly conducting. Doing so in an inexpensive way is also important.

SUMMARY OF THE INVENTION

One object of the present invention is to provide a fusistor arrangement that alleviates the above-mentioned problems of the prior art.

The object is achieved by a fuse and resistor device according to the present invention as defined in claim 1.

Thus, in accordance with an aspect of the present invention, there is provided a fuse and resistor device for a solid state lighting device, wherein at least a part of the fuse and resistor device embodies a connection pin arranged to be received at a power supply socket. The connection pin comprises an elongated conducting structure, and an insulating support structure supporting and partly enclosing the conducting structure. The conducting structure comprises a dampening resistor. The fuse and resistor device further comprises a fuse connected with the dampening resistor. Thus, fuse and resistor device like a fusistor, the fuse and resistor device operates as both a fuse and a dampening resistor. At least the dampening resistor is mounted at the connection pin, being housed in or integral with the connection pin. Thereby, the circuit board of a solid state lighting device at which the fuse and resistor device is mounted will not be subject to the heat generated by the damping resistors, but instead the heat will be removed via the pin and the cap of the solid state lighting device and/or the connection to a power network. Consequently, a substantial heat source has been removed from the circuit board, and thereby the thermal load on the circuit board has been decreased. Additionally, more room is available to spread the remaining components apart.

It should be noted that the term "solid state lighting" (SSL) is to be understood as any light source which generates light by solid-state electroluminescence, such as a LED (Light Emitting Diode), an OLED (Organic Light Emitting Diode), and a PLED (Polymer Light Emitting Diode).

In accordance with an embodiment of the fuse and resistor device, the conducting structure comprises the fuse. Thereby both functions are closely gathered.

In accordance with an embodiment of the fuse and resistor device, the dampening resistor and the fuse are integrated into one element. Thereby, the assembly of the fuse and resistor device is simplified.

In accordance with an embodiment of the fuse and resistor device, the fuse is a separate component arranged outside of the connection pin. Thereby, the current level at which the fuse fuses is more controllable than when the fuse is arranged within the pin. In accordance with an embodiment of the fuse and resistor device, it is demountably mountable at a housing of the solid state lighting device. In other words it is possible to easily exchange the fuse and resistor device if the fuse function has been activated, i.e. the fuse has blown. Embodiments that provide the demountability have a support structure which, for instance, comprises a bayonet connection or an outer thread.

In accordance with an embodiment of the fuse and resistor device, at least a portion of the support structure that encloses at least a portion of the wire conductor is made of a transparent material. In other words at least a portion of the wire conductor is visible through the support structure.

In accordance with an embodiment of the fuse and resistor device, the first end portion constitutes a first end cap.

In accordance with an embodiment of the fuse and resistor device the second end portion constitutes a second end cap.

In accordance with another aspect of the present invention, there is provided a solid state lighting device comprising a fuse and resistor device according to any one of the preceding claims.

These and other aspects, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF EMBODIMENTS

Figure 1:
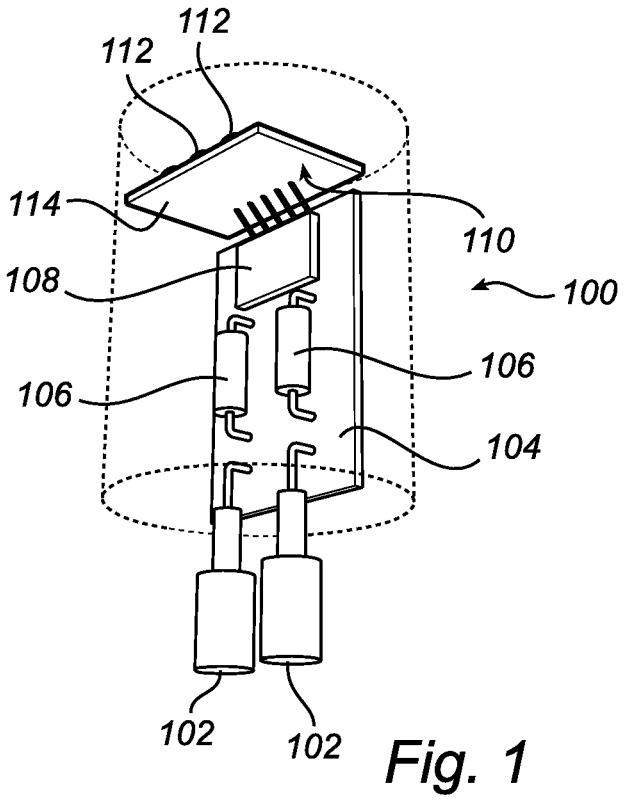
FIG. 1 is a perspective view, of a the interior of a prior art SSL device.
Figure 2:
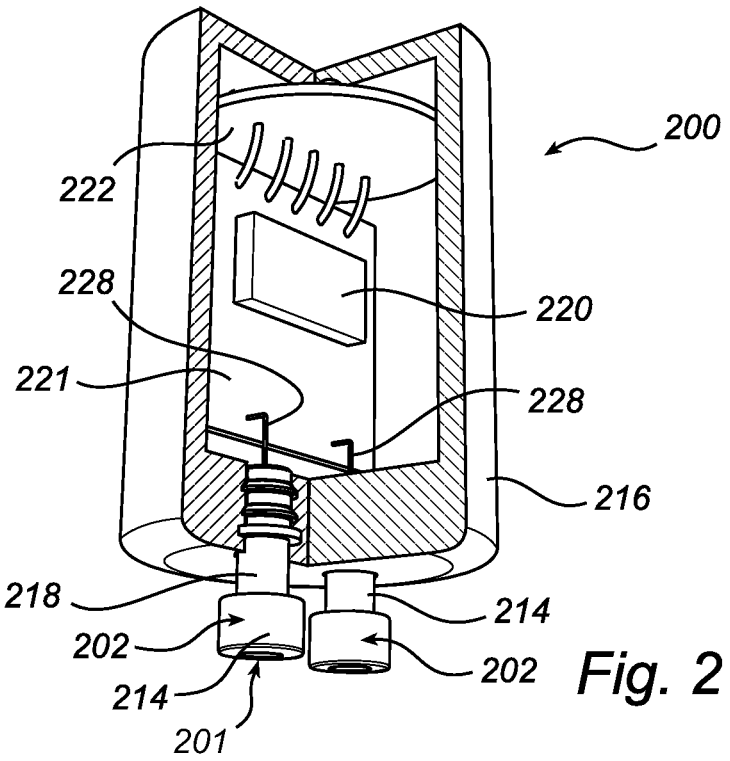
FIG. 2 is a perspective, partly cut away view of an embodiment of an SSL device according to present invention.
Figure 3:
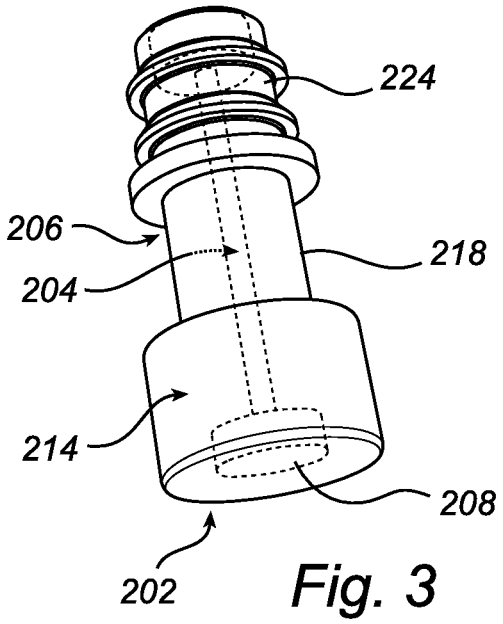
FIG. 3 is a perspective view of an embodiment of a fuse and resistor device, included in the SSL device of FIG. 1, according to the present invention.
Figure 4:
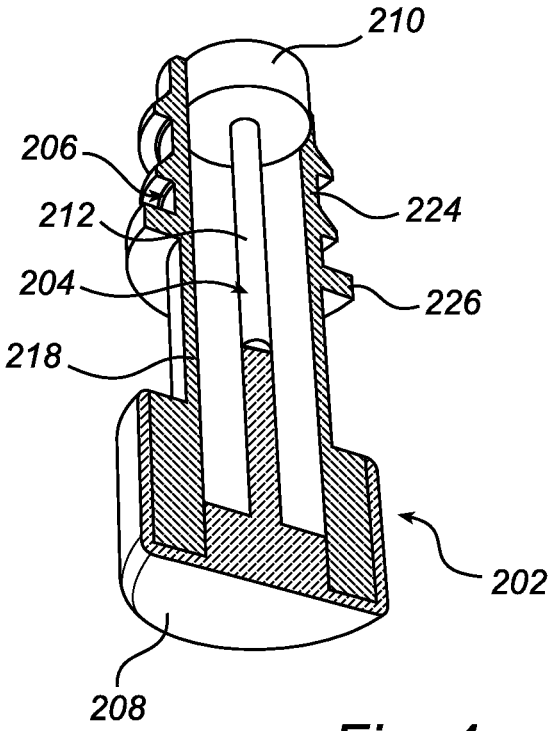
FIG. 4 is a cross-sectional view of the fuse and resistor device of FIG. 3.

As shown in FIGS. 2 to 4, an SSL device 200, such as a LED lamp, includes a first embodiment of a fuse and resistor device 201. The fuse and resistor device 201 embodies a connection pin 202, which comprises an elongated conducting structure 204, and an insulating support structure 206, which supports and partly encloses the conducting structure 204. The conducting structure 204 comprises a first end portion 208, a second end portion 210, and an intermediate portion 212 interconnecting the first and second end portions 208, 210, and being constituted by a wire conductor 212, which is enclosed by the support structure 206. The connection pin 202 is mounted at a housing 216 of the SSL device 200, and a protruding portion 214 of the connection pin 202 protrudes from the housing 216, and is arranged to be received at a power supply socket, such as an alternating current socket, which is a mains supply to the SSL device 200.

The first end portion 208 of the connection pin 202 constitutes an end most portion of the protruding portion 214, and a first portion 218 of the support structure 206 constitutes the rest of the protruding portion 214.

The second, and opposite, end portion 210 of the connection pin 202 is arranged to be connected with drive circuitry 220 of the solid state lighting device 200. The drive circuitry 220 is arranged on a first circuit board 221, which typically is a PCB, and drives the very light emitting unit 222, such as LEDs, of the SSL device 200.

A second portion 224 of the support structure 206 comprises a retaining element embodied by an outer thread 226, which has been threaded into the housing 216. Thereby a simple mounting is obtained. Optionally, the fuse and resistor device, or connection pin, 202 is demountable from the housing 214 of the SSL device 200, and replaceable with a whole fuse and resistor device 201 when it has blown.

According to this embodiment, the first end portion 208 is embodied as a first end cap, and the second end portion 210 is embodied as a second end cap. The second end cap 210 is connected with the circuit board 221 carrying the drive circuitry 220, by means of a wire connection 228 capable of withstanding a higher current than the wire conductor 212. The first end cap 208 is generally bucket shaped and encloses an end of the support structure 206. At least a major part of the support structure 206 is tubular, leaving an air filled space around the wire conductor 212.

The support structure 206 is made of a transparent material, such as a transparent plastic. The transparency is used for making it easy to check whether the wire conductor 212, providing the fuse function, is whole or not. Of course it is enough that the first portion 218 of the support structure 206 is transparent, but to simplify manufacture the support structure 206 is made as an integral piece. On the other hand, alternatively there is no use of transparency if the conventional way of using a LED lamp is practised, which means that when the lamp ceases to work it is simply exchanged without checking the cause of failure.

Furthermore, the support structure 206 is thermally and electrically insulating, while the conducting structure 204 is electrically and thermally conducting. However, in addition to the fuse function of the conducting structure 204, realized by the wire conductor 212, the conducting structure 204 has a dampening function as mentioned above. Consequently, in this embodiment the fuse and the resistor are integrated into one element, i.e. they constitute an integral part of the connection pin 202. This means that the conducting structure 204 has to be provided with an appropriate resistance, and that the thickness of the wire conductor 212 has to be chosen such that it can withstand a predetermined breakdown current, i.e. maximum current before it melts. The choice of material can be used as a dimensioning parameter as well. The same parameters, i.e. thickness and material, are typically varied in order to obtain a desired resistance of the conducting structure 204 as well. However, it is not a difficult issue to provide a conducting structure 204 which fulfils the desires of both resistance and breakdown current. The support structure 206 has the additional purpose of fine-tuning the fuse and resistor device 201, with respect to power dissipation over time. This is because if the fuse and resistor device 201 is cooled too much, it is not capable of covering hazardous situations in the driver of the SSL device 200.

When the SSL device 200 is in operation, i.e. when it has been mounted at a power supply socket, the fuse and resistor devices 202 dampen the current peaks due to phase-cut dimming of the SSL device 200. If the current through any of the fuse and resistor devices 202 exceeds the breakdown current it blows. Then it is possible to demount the SSL device 200, look through the transparent part 218 of the connection pin 214 which fuse and resistor device is broken and replace it with a new one. Alternatively, the whole SSL device is replaced, as done so far.

Figure 5:
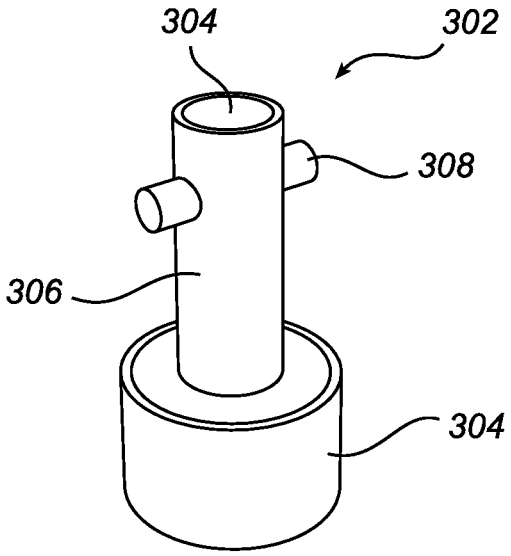
FIG. 5 is a perspective view of another embodiment of a fuse and resistor device according to the present invention.
Figure 6:
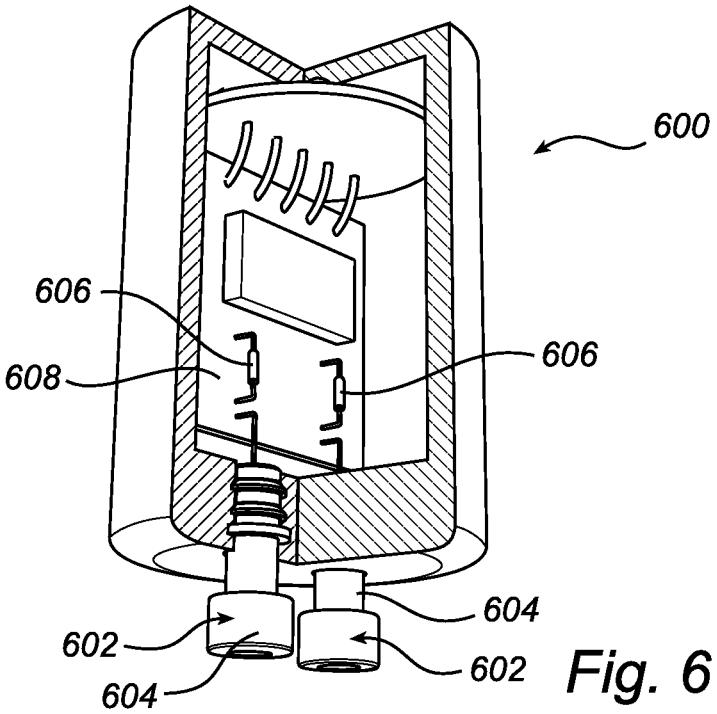
FIG. 6 is a perspective, partly cut-away view of an SSL device using another embodiment of a fuse and resistor device according to the present invention.

According to a second embodiment of the fuse and resistor device 300, as shown in FIG. 5, it has the similar construction of a conducting structure 304 and an insulating support structure 306, as the first embodiment described above, except for the retaining element. Instead of an outer thread as in the first embodiment, the support structure 306 comprises a bayonet element 308.

A third embodiment of the fuse and resistor device has a structure that is generally similar to that of the above-described embodiments, except for one important difference. The third embodiment of the fuse and resistor device 602, as shown mounted in an SSL device 600, comprises two separate parts, where one part is the connection pin 604, and the other part is a separate fuse 606, which has been mounted on the circuit board 608 of the SSL device. The dampening resistor is, however, still integrated in the connection pin 604. The fuse 606 is connected with the conducting structure of the connection pin 604. It is not shown in this drawing for reasons of simplicity, but the interior of the connection pin 604 looks about the same as the interior 212 of the connection pins 202 of the first embodiment of the fuse and resistor device. The main difference of the interior of the connection pin 604 is that the material and dimension chosen for the conducting structure embodying the dampening resistor is different from the above-described alternative of both fuse and resistor included in the pin, primarily regarding the wire conductor 212.

Figure 7:
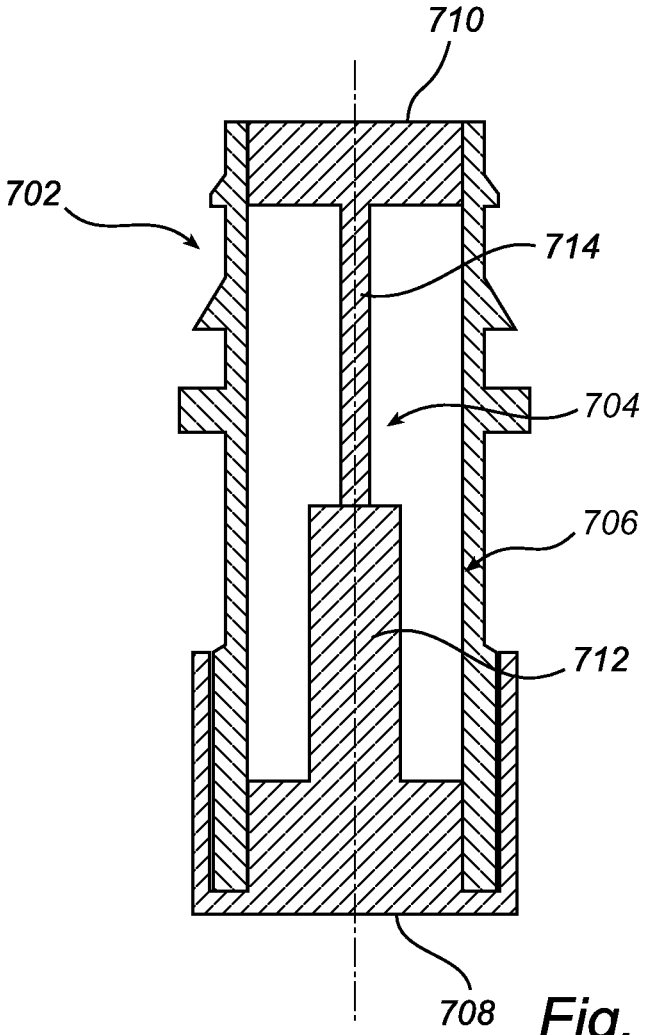
FIG. 7 is a cross-sectional view of another embodiment of the fuse and resistor device.

According to a fourth embodiment of the fuse and resistor device, as shown in FIG. 7, the fuse and the dampening resistor are separate components, but they are both comprised in the connection pin. Thus, like in the first embodiment, the fuse and resistor device embodies a connection pin 702, which comprises an elongated conducting structure 704, and an insulating support structure 706, which supports and partly encloses the conducting structure 704. However, the conducting structure 704 is differently structured than that of the first embodiment. The conducting structure 704 comprises a first end portion 708, which is arranged to be received in a socket, a second end portion 710, which is arranged to be connected with the circuit board of an SSL device, and an intermediate portion, being wire shaped and interconnecting the first and second end portions 708, 710. The conducting structure 704 primarily consists of two halves 712, 714. One of the halves 712, including the first end portion 708, constitutes the dampening resistor, and the other half 714, including the second end portion 710, constitutes the fuse. The dampening resistor 712 and the fuse 714 are made of different materials, and/or are differently dimensioned in order to obtain the desired functions. They are attached to each other forming a one piece conducting structure 704.

Above embodiments of the fuse and resistor device, and the SSL device, according to the present invention as defined in the appended claims have been described. These should only be seen as merely non-limiting examples. As understood by the person skilled in the art, many modifications and alternative embodiments are possible within the scope of the invention as defined by the appended claims.

Thus, as explained by the embodiments above, the major heat generating part of the fusistor, i.e. the dampening resistor, has been moved to the connection pin, and thereby the thermal power load of the circuit board has been significantly reduced. Optionally, the fuse as well can be provided in the connection pin, preferably integral with the dampening resistor, and in the latter case the connection pin can be regarded as comprising a fusistor.

It is to be noted that for the purposes of his application, and in particular with regard to the appended claims, the word "comprising" does not exclude other elements or steps, and the word "a" or "an" does not exclude a plurality, which per se will be evident to a person skilled in the art.

The invention claimed is:

1. A fuse and resistor device for a solid state lighting device, the solid state lighting device having a light emitting unit and a circuit board for driving the light emitting unit, characterized in that at least a part of the fuse and resistor device embodies a connection pin arranged to be received at a power supply socket, wherein the connection pin comprises a conducting structure, and an insulating support structure supporting and partly enclosing the conducting structure, wherein the conducting structure comprises a dampening resistor, and wherein the fuse and resistor device further comprises a fuse connected with the dampening resistor so that the circuit board will not be subject to heat generated by the dampening resistors.

2. The fuse and resistor device according to claim 1, wherein the conducting structure comprises the fuse.

3. The fuse and resistor device according to claim 2, wherein the dampening resistor and the fuse are integrated into one element.

4. The fuse and resistor device according to claim 1, wherein the fuse is a separate component.

5. The fuse and resistor device according to claim 4, wherein the conducting structure comprises a first end portion, a second end portion and an intermediate portion interconnecting the first and second end portions and being constituted by a wire conductor, which is enclosed by the support structure, wherein the first end portion constitutes at least a portion of the connection pin, and wherein the second end portion is arranged to be connected with a circuit board of a solid state lighting device.

6. The fuse and resistor device according to claim 5, further being demountably mountable at a housing of the solid state lighting device.

7. The fuse and resistor device according to claim 6, wherein the support structure comprises a bayonet element.

8. The fuse and resistor device according to claim 6, wherein the support structure comprises an outer thread.

9. The fuse and resistor device according to claim 8, wherein at least a portion of the support structure enclosing at least a portion of the wire conductor is made of a transparent material.

10. The fuse and resistor device according to claim 9, wherein said first end portion constitutes a first end cap.

11. The fuse and resistor device according to claim 10, wherein the second end portion constitutes a second end cap.

12. A solid state lighting device comprising a fuse and resistor device according to claim 11.

13. A solid state lighting device comprising a fuse and resistor device according to claim 4, and a circuit board having driving circuitry mounted thereon, wherein the fuse is mounted on the circuit board.

* * * * *